United States Patent [19]

Whittingham

[11] 4,040,917

[45] Aug. 9, 1977

[54] PREPARATION OF INTERCALATED CHALCOGENIDES

[75] Inventor: M. Stanley Whittingham, Fanwood, N.J.

[73] Assignee: Exxon Research and Engineering Company, Linden, N.J.

[21] Appl. No.: 673,695

[22] Filed: Apr. 5, 1976

Related U.S. Application Data

[63] Continuation-in-part of Ser. No. 592,592, July 2, 1975, abandoned, which is a continuation-in-part of Ser. No. 396,001, Sept. 10, 1973, abandoned.

[51] Int. Cl.[2] ..... C25B 1/00

[52] U.S. Cl. ..... 204/92; 204/86; 204/130; 252/62.3 V

[58] Field of Search ..... 204/86, 92, 112, 115, 204/130, 195 R, 195 M; 252/62.3 V, 2 T; 423/509; 429/30-33

[56] References Cited

U.S. PATENT DOCUMENTS

| | | | |
|---|---|---|---|
| 846,642 | 3/1907 | Anderson | 204/115 |
| 3,709,813 | 1/1973 | Johnson et al. | 204/195 G |
| 3,728,159 | 4/1973 | Varga | 429/40 |
| 3,811,855 | 5/1974 | Carlson et al. | 204/130 |
| 3,826,971 | 7/1974 | Jasinski et al. | 204/195 M |
| 3,836,443 | 9/1974 | MacGregor | 204/108 |
| 3,909,384 | 9/1975 | Jasinski et al. | 204/195 M |

FOREIGN PATENT DOCUMENTS

| | | | |
|---|---|---|---|
| 1,939,267 | 2/1971 | Germany | 204/130 |

OTHER PUBLICATIONS

DiSalvo, "Layered Compounds, Intercalation and Magnetic Susceptibility Measurements", *Low Temperature Physics,* BT13, vol. 3, pp. 417-427.

*Primary Examiner*—T. Tung
*Attorney, Agent, or Firm*—M. A. Ciomek; K. P. Glynn

[57] ABSTRACT

Ions are intercalated in chalcogenides by flowing a current through a system comprising a cathode which contains the chalcogenides (e.g., $TaS_2$ is a suitable chalcogenide), an anode containing electronically conductive material which is not a source of the intercalating ions (a suitable anode material would be gold) and an electrolyte comprising or containing at least one ionically conducting material which will electrochemically release ions of the species which are to be intercalated in the chalcogenide (e.g., dilute HCl, in which case hydrogen ions would be intercalated in the chalcogenide). The voltage is applied at a level sufficient to permit electrochemical decomposition of the electrolyte to thereby release the ions to be intercalated into the chalcogenide. Alternatively, the anode may act as the source of the intercalating ions and the electrolyte would comprise or contain at least one compound of the same species as that of the ions to be intercalated (e.g., a suitable anode would be lithium metal and a suitable electrolyte would be LiI in propylene carbonate). In this alternate method, an electrical circuit is provided within the system and the voltage within the system is controlled such that ions are released from the anode to intercalate into the chalcogenide.

18 Claims, No Drawings

PREPARATION OF INTERCALATED CHALCOGENIDES

CROSS-REFERENCE TO RELATED APPLICATION

This application is a continuation-in-part of U.S. Ser. No. 592,592, filed July 2, 1975, now abandoned, which in turn was a continuation-in-part of U.S. Ser. No. 396,001, filed Sept. 10, 1973.

BACKGROUND OF THE INVENTION

This invention relates to methods for intercalating chalcogenides. In the past, chalcogenides have been intercalated under conditions such that the quantities of the reactants must be controlled and generally past methods of preparation required elevated temperatures and significant periods of time (ranging from several hours to several months) for preparation. In contrast thereto, the present methods of intercalation permit the degree of intercalation to be controlled very readily by controlling the current passed into the system without the need to control the quantities of the reactants. Furthermore, the present methods of intercalation permit control and monitoring of the thermodynamic activity of the intercalated specie as well as permitting the reaction to be performed quite rapidly at room temperature, thus eliminating the problem of intercalating those chalcogenides which might otherwise be decomposed at elevated temperatures. The resultant intercalated compounds are known to be useful as lubricants, X-ray diffraction grating crystals, superconductors, and thermo-electric elements, e.g., see published German patent application 2,061,162, Australian Journal of Chemistry, Volume II, page 471 et seq (1958) and the Journal of Chemical Physics, Volume 58, page 697 et seq (1973).

SUMMARY OF THE INVENTION

The present invention involves the preparation of intercalated chalcogenides by controlling the flow of current through a system comprising a cathode, an anode and an electrolyte. The components of this system as well as the controlled current flow to be utilized in the two types of methods (denoted herein as Method A and Method B) for intercalating the chalcogenides will now be described herein in greater detail.

I. METHOD A

The Cathode

The cathode contains as the cathode-active material the chalcogenides to be intercalated. The cathode itself need not necessarily consist solely of the cathode-active material but may be a structure or material such as carbon, copper, nickel, zinc, silver, etc., with which the chalcogenide is deposited or mixed. Preferably, the cathode consists entirely of the chalcogenide to be intercalated.

The chalcogenide to be intercalated may be any of those dichalcogenides (or lower chalcogenides) which are capable of being intercalated. Either the pure chalcogenides or alloys (of both the cation and the anion) of chalcogenides may be used. These chalcogenides are well known in the prior art and may be represented by the general formula $MZ_x$ wherein M is at least one metal selected from the group consisting of titanium, zirconium, hafnium, vanadium, niobium, tantalum and molybdenum; Z is at least one chalcogen selected from the group consisting of sulfur, selenium and tellurium; and $x$ has a numerical value between about 1 and about 2.05. Preferably, the metal is at least one member selected from the group consisting of titanium, zirconium, hafnium, niobium or tantalum and the chalcogen (i.e. Z) is sulfur or selenium. The subscript $x$ preferably has a value in the range of 1.95 to 2.02 (a value of 2.00 is most preferred). Especially useful chalcogenides are those having a layered structure analogous to that of graphite (e.g., $TaS_2$).

The Anode

The anode is one which contains as the anode-active material an element or compound which is an electronic, conductor, but is one which does not release ions into the electrolyte that are subsequently intercalated into the chalcogenide, such as noble metals, Group IVb metals, Group Vb metals, Group VIb metals, Group VIIb metals, Group VIII metals and compounds of the aforesaid metals. Examples of such compounds include the nitrides, borides, carbides, etc.

As in the case of the cathode, the anode may be fabricated entirely from the element or compound to be used as the anode-active material (which is preferred) or it may consist of an underlying structure (fabricated of an electronically conductive material such as copper, nickel, platinum, etc.) upon which the anode-active material is deposited. Furthermore, the anode-active material may consist of alloys or mixtures of any of the above materials rather than a single material.

The Electrolyte

The electrolyte useful in Method A comprises or contains a salt that can be conveniently represented by the general formula LX wherein L is the intercalating species and is at least one cationic moiety selected from the group consisting of Group Ia metals, Group Ib metals, Group IIa metals, Group IIb metals, Group IIIa metals, ammonium (or substituted ammonium such as pyridinium), and wherein X is at least one anionic moiety selected from the group consisting of halides, sulfates, nitrates, beta-aluminas, phosphofluorides, thiocyanates and perchlorates.

Especially useful electrolyte materials include lithium perchlorate, lithium hexafluorophosphate, lithium thiocyanate, sodium beta-alumina, ammonium iodide, hydrogen chloride, potassium thiocyanate, potassium chloride and magnesium chloride. The electrolyte may be present in a pure state (in the form of a solid or liquid) or it may be conveniently dissolved in a suitable solvent such as water, alcohols, ketones, esters, ethers, organic carbonates, organic lactones, amides, sulfoxides, nitrohydrocarbons and mixtures of such solvents. Where a solvent is utilized, the electrolyte salt may be present in a range of concentrations determined by the electrolyte conductivity and chemical reactivity and solubilities.

The Current

After the system described above has been assembled intercalation proceeds by applying a current to the system at a voltage level such that the electrolyte will electrochemically decompose to thereby release the ions to intercalate into the chalcogenide. Preferably, in order to prevent the formation of an electro-deposited coating on the surface of the chalcogenide, the current is applied such that the cathode is placed at a potential of at least about 1 millivolt more positive than that required for electrodeposition of the intercalating species on an inert material.

In determining the preferable level of current, all that is necessary is that, in place of the cathode containing the chalcogenide, the system utilizes a reference cathode which contains as the cathode-active material an electronically conductive material (such as platinum) which will not electrochemically react with the electrolyte or the products of decomposition of the electrolyte and thereafter determine the potential required for electrochemical decomposition of the electrolyte utilizing the anode and the reference cathode. Once the determination of this potential has been made, the reference cathode is removed from the system and replaced with the cathode containing as the cathode-active material the chalcogenide to be intercalated and the current which is applied is such that the cathode is maintained at a potential of at least one 1 millivolt more positive than that which was determined utilizing the reference cathode.

Alternatively, the preferable level of current can be readily determined by use of a third electrode, a reference electrode, which is used to monitor the cathode potential. By the use of a potentiostat, the current can be automatically controlled to maintain a predetermined cathode potential. When the reference electrode comprises the pure material to be intercalated, then the cathode potential is maintained at a value of at least about 1 millivolt more positive than the reference electrode.

The potential to be applied to the system in Method A depends on the selected intercalating species as well as the selected chalcogenide to be intercalated. As a general rule, the potential should be at a level at least sufficient to provide enough driving force for electrolytically decomposing the electrolyte so as to provide the source of the intercalating ions and to intercalate the cathode active material. At the opposite extreme, the potential should preferably not be so high such that ions from the electrolyte are deposited on the surface of the cathode-active material rather than intercalated into the cathode-active material (in the case of materials wherein the ions are, for example, hydrogen, ammonium, etc., the term "deposited" would mean that a bubbling away of the gases at the surface of the chalcogenide rather than intercalation of the ions into the chalcogenide would occur). That intercalation of the chalcogenides proceeds at a satisfactory rate rather than deposition at the surface of the chalcogenide may be readily determined by use of a third, reference electrode and a coulometer to monitor the total current passed and hence the number of charged species discharged, X-ray analysis of the chalcogenide, and visual inspection.

In a typical system which utilizes a chalcogenide such as tantalum disulfide in an amount of 10 mg. for the cathode and cobalt wire in an amount of 100 mg. for the anode in an electrolyte consisting of $NH_4I$ in acetone, substantially full intercalation of the chalcogenide by the ammonium ions may take place over a period of about 3hours utilizing a voltage of about 2volts. Thus, a suitable voltage would vary from 1 volt to 2 volts, and the resulting current would be 1–2 ma./10 mg. of tantalum disulfide.

II. METHOD B

The Cathode

The cathode to be used in Method B will contain as the cathode-active material any of those materials described as being suitable for the cathode-active material in Method A above.

The Anode

In Method B, the anode (rather than the electrolyte in Method A) is employed as the source of the ions which are to be intercalated into the chalcogenide. Accordingly, the anode should contain as the anode-active material any electronically conductive material which will electrochemically release ions which are to be intercalated into the chalcogenide. Thus, suitable anode-active materials may be at least one member selected from the group consisting of Group Ia metals, Group Ib metals, Group IIa metals, Group IIb metals, Group IIIa metals and mixtures of the aforesaid metals with other substances such that the aforesaid metals can be electrochemically released from the mixture. Other suitable anode-active materials include materials which are capable of releasing hydrogen and ammonium ions (e.g., $LaNi_5H_x$ or $Hg(NH_4)_x$). Preferably, the anode-active material is a Group I metal such as lithium, sodium, potassium, copper or silver. Here again, the anode may consist entirely of the anode-active material (which is preferred) or the anode-active material may be deposited on a supporting structure which in turn may be constructed of materials such as copper, platinum, etc., which are preferably electronically conductive, but which are not the source of the intercalating ions. Furthermore, the anode-active material may also consist of alloys, compounds or solutions of the above materials provided that the alloys, compounds or solutions meet the requirement that they are electronically conductive and are capable of electrochemically releasing ions which are to be intercalated into the chalcogenide.

The Electrolyte

The electrolyte comprises (or may contain) a compound of the same species as that of the ions to be intercalated into the chalcogenide (i.e. the electrolyte can contain a mixture of salts but it must contain a salt having a cationic moiety of the element employed as the anode-active material). Thus, the electrolyte contains or comprises a salt that may be conveniently represented by the formula LX wherein L is at least one cationic moiety selected from the group consisting of Group Ia metals, Group Ib metals, Group IIa metals, Group IIb metals, Group IIIa metals and ammonium; and X is an anionic moiety or moieties selected from the group consisting of halides, sulfates, nitrates, beta-aluminas, phosphofluorides, thiocyanates, and perchlorates. As in the case of Method A, the electrolyte may be present in the form of a solid, molten or liquid pure compound or may be present in the form of a solution in a suitable solvent. For the purposes of Method B, the term "suitable solvent" should be understood as one which would not result in a chemical reaction with the selected anode-active material. Thus, although the same electrolyte solvents which are indicated hereinabove as being possibly useful in practicing Method A may also be utilized for Method B, certain combinations of the selected anode-active material and electrolyte solvent are not possible (for example, pure lithium could not be used as the anode-active material in the presence of an electrolyte solvent consisting of or comprising water or an alcohol).

The Current

In Method B, an external current need not necessarily be applied to the system since the system of itself is a source of current. Rather, the current flow which is generated by the system should preferably be controlled such that the ions released from the anode are intercalated into the chalcogenide rather than deposited on the surface of the chalcogenide. The control of the current developed by this system may be readily accomplished by utilizing a resistor in the circuit (variable resistors are also quite useful) or by providing an opposing potential (such as with the use of a potentiostat) to insure intercalation. Here again, as in the case of Method A, the voltage across the system should be such that there is sufficient driving force to result in release of the ions from the anode-active material to intercalate into the chalcogenide, but preferably should not be such that the ions are significantly deposited on the surface of the chalcogenide. The particular flow of current with the system in the case of Method B will depend on the selected anode-active material which is to form the intercalating ions as well as the chalcogenide to be intercalated. However, a satisfactory rate of intercalation of the chalcogenide using Method B may be determined by the same method described hereinabove with reference to Method A.

In a typical system for practicing Method B which utilizes a chalcogenide such as $TaS_2$ in an amount of 20 mg. for the cathode and copper wire in an amount of 50 mg. for the anode in an electrolyte consisting of copper sulfate in water, substantially full intercalation of the chalcogenide by the copper ions may take place over a period of about 3 hours in which the initial current flow is about 1 ma. Thus, a suitable current flow would vary from 1 ma. to 0.1 ma. per 20 mg/crystal where the cathode is at +50 mv. potential relative to a copper wire reference electrode.

The term "Group" as applied to one or more elements or compounds refers to a particular Group of the Periodic Table of the Elements of the type set forth on the inside cover the *The Merck Index* (7th ed.). The following examples shall serve to illustrate the intercalation of chalcogenides by Method A and Method B.

EXAMPLE 1

Method A

A single crystal of tantalum disulfide was indium soldered to a copper wire. The crystal weighed about 10 mg. This was the cathode. A cobalt wire of diameter 0.020 inches served as the anode. A saturated solution of ammonium iodide in acetone served as the electrolyte. This was contained in a beaker and the anode and cathode were dipped into the solution. A slowly increasing voltage was then applied to the cell, and a current began to flow above 0.8 volts. The potential was then held steady at 2 volts for about 5 hours, during which time the cathode crystal turned from a dark blue to a black color, which is indicative of intercalation, and the electrolyte solution turned from colorless to a very deep red color due to the formation of iodine at the anode. A current in the range 1 to 2 ma. flowed during the period; X-ray analysis indicated that intercalation had taken place.

EXAMPLE 2

Method A

A gold wire anode and a gold wire cathode of diameter 0.05 inches were immersed in an N/10 aqueous hydrochloric acid solution. The current flowing through the cell was measured as a function of the applied voltage; from this a value of the decomposition potential of the electrolyte was determined. The gold wire cathode was then replaced by a tantalum disulfide crystal mounted as in Example 1. The drop in decomposition potential, which was shown by the use of a third, reference electrode to be entirely due to a decrease in the cathodic potential, is an indication that intercalation of hydrogen is taking place. Below 1.5 volts, the decomposition potential of the electrolyte, no gaseous evolution was observed at the sulfide cathode. The system was then left under an applied potential of 1.26 volts and the current fell to zero (initially about 1 ma.); X-ray analysis indicated that intercalation had taken place.

EXAMPLE 3

Method B

A silver wire anode and a 2.3 mg. single crystal of tantalum disulfide, mounted as above examples, were dipped into an almost saturated solution of silver nitrate in water. The open circuit voltage, i.e. no current flow, of this cell was -0.14 volts, the $TaS_2$ being more positive than the silver. On changing this to a -0.10 v by application of an external potential, a current of 0.37 ma. flowed; this decayed with time indicative of a diffusion controlled process, namely silver diffusion into the tantalum sulfide lattice. The cell was then shorted to speed up intercalation; this caused some deposition of silver metal on the crystal which was subsequently removed electrolytically by applying a reverse potential. After one hour, the crystal was removed, weighed and X-rayed. The change in weight indicated a composition of $Ag_{0.6}TaS_2$.

EXAMPLE 4

Method B

A copper wire anode and a 20 mg. single crystal of tantalum disulfide were dipped into a saturated solution of copper sulfate in water. A copper reference electrode was also dipped into this solution. The initial open circuit voltage of the cell was −0.2 volts, the $TaS_2$ being positive relative to the copper anode. An external potential was applied to hold the $TaS_2$ cathode at 50 mv positive relative to the reference electrode. A current then flowed through the system, initially 1 ma decaying to 0.1 ma after 3 hours. A coulometer measurement of the current flow indicated a composition $Cu_{0.20}TaS_2$.

What is claimed is:

1. A process for the preparation of intercalated chalcogenides which comprises applying a current to a system comprising:

a. a cathode containing as the cathode-active material the chalcogenide to be intercalated, said chalcogenide having a layered structure and having the fomrula $MZ_x$ wherein M is at least one metal selected from the group consisting of titanium, zirconium, hafnium, vanadium, niobium, tantalum and molybdenum; Z is at least one chalcogen selected from the group consisting of sulfur, selenium and tellurium; and $x$ has a numerical value between about 1 and about 2.05;

b. an anode containing as the anode-active material an electronically conductive material selected from the group consisting of Group IVb metals, Group Vb metals, Group VIb metals, Group VIIb metals, Group VIII metals and electronically conductive compounds of the aforesaid metals; and c. an electrolyte comprising an ionically conductive material which will provide the cathode with ions of the species which are to intercalate the chalcogenide, said electrolyte having the formula LX wherein L is the intercalating species and is at least one cationic moiety selected from the group consisting of Group Ia metals, Group Ib metals, Group IIa metals, Group IIb metals, Group IIIa metals, ammonium and substituted ammonium; X is at least one anionic moiety selected from the group consisting of halides, sulfates, nitrates, beta-alumina, phosphofluorides, thiocyanates and perchlorates, said current being applied at a voltage sufficiently high to cause the intercalation of the cathode active material and sufficiently low to avoid deposition onto the chalcogenide of the species being intercalated into the chalcogenide.

2. The process of claim 1 in which the chalcogenide is one which has a layered structure and M is at least one metal selected from the group consisting of titanium, zirconium, hafnium, niobium, tantalum and alloys thereof; Z is selected from the group consisting of sulfur and selenium; and $x$ has a numerical value between 1.95 and 2.02.

3. The process of claim 2 wherein $x$ has a numerical value of 2.00.

4. The process of claim 2 in which the chalcogenide is $TaS_x$.

5. The process of claim 2 in which the chalcogenide is $TiS_x$.

6. The process of claim 1 in which the electrolyte is present as a solution in a solvent selected from the group consisting of water, alcohols, ketones, esters, ethers, organic carbonates, organic lactones, amides, sulfoxides, nitrohydrocarbons and mixtures of such solvents.

7. The process of claim 1 in which the electrolyte comprises a solution of hydrogen chloride.

8. The process of claim 1 in which the electrolyte comprises a solution of an ammonium salt.

9. The process of claim 1 in which the current is applied such that the cathode is placed at a potential of at least 1 millivolt more positive than that required for electrochemical decomposition of the electrolyte utilizing a system in which both the cathode and the anode contain as the cathode-active material and anode-active material, respectively, an electronically conductive material which will not chemically react with the electrolyte.

10. A process for the preparation of intercalated chalcogenides which comprises controlling the voltage in a system comprising:

a. a cathode containing as the cathode-active material the chalcogenide to be intercalated, said chalcogenide having a layered structure and having the formula MZx wherein M is at least one metal selected from the group consisting of titanium, zirconium, hafnium, vanadium, niobium, tantalum and molybdenum; Z is at least one chalcogen selected from the group consisting of sulfur, selenium and tellurium; and $x$ has a numerical value between about 1 and about 2.05.

b. an anode containing as the anode-active material an electronically conductive material which will provide ions which are to be intercalated into said chalcogenide, said anode-active material being at least one member selected from the group consisting of Group Ia metals, Group Ib metals, Group IIa metals, Group IIb metals, Group IIIa metals and mixtures of the aforesaid metals with other substances which are capable of releasing the aforesaid metals electrochemically from the mixture, hydrogen-containing materials which are capable of electrochemically releasing hydrogen therefrom and ammonium-containing materials which are capable of electrochemically releasing ammonium ions therefrom; and, c. an electrolyte comprising at least one salt having the formula LX wherein L is at least one cationic moiety selected from the group consisting of Group Ia metals, Group Ib metals, Group IIa metals, Group IIb metals, Group IIIa metals and ammonium; and X is an anionic moiety or moieties selected from the group consisting of halides, sulfates, nitrates, beta-aluminas, phosphofluorides, thiocyanates and perchlorates, provided that at least one salt is a salt of the anode-active material;

the voltage within said system being controlled to be sufficiently high such that the electrolyte is provided with ions of the species which are to intercalate the chalcogenide and such that the chalcogenide is intercalated and to be sufficiently low to avoid deposition onto the chalcogenide of the species being intercalated into the chalcogenide.

11. The process of claim 10 in which the chalcogenide is one which has a layered structure and M is at least one metal selected from the group consisting of titanium, zirconium, hafnium, niobium, and tantalum; Z is selected fron the group consisting of sulfur and selenium; and $x$ has a numerical value between 1.95 and 2.02.

12. The process of claim 11 wherein $x$ has a numerical valve of 2.00.

13. The process of claim 11 in which the chalcogenide is $TaS_x$.

14. The process of claim 11 in which the chalcogenide is $TiS_x$.

15. The process of claim 10 in which the anode-active material is selected from the group consisting of lithium, sodium, potassium, copper and silver.

16. The process of claim 10 in which the anode-active material is lithium.

17. The process of claim 10 in which the electrolyte is present as a solution in a solvent selected from the group consisting of water, alcohols, ketones, esters, ethers, organic carbonates, organic lactones, amides, sulfoxides, nitrohydrocarbons and mixtures of such solvents.

18. The process of claim 10 in which the current flow is controlled such that the cathode is at a potential of at least about 1 millivolt more positive than that required for deposition of the species being intercalated on an inert cathode.

* * * * *